United States Patent [19]

Pennock

[11] Patent Number: 4,598,860

[45] Date of Patent: Jul. 8, 1986

[54] FLIP DIE CUT LABEL FOR FOLDED MAILER

[75] Inventor: Thomas G. Pennock, North Tonawanda, N.Y.

[73] Assignee: Moore Business Forms, Inc., Grand Island, N.Y.

[21] Appl. No.: 721,497

[22] Filed: Apr. 9, 1985

Related U.S. Application Data

[63] Continuation of Ser. No. 539,129, Oct. 5, 1983, abandoned.

[51] Int. Cl.[4] ..... B65D 27/10; B41J 13/24

[52] U.S. Cl. ..... 229/69; 229/75; 270/41; 270/51; 283/106; 400/622

[58] Field of Search ..... 229/68 R, 69, 70, 73, 229/75; 270/41, 51; 400/622; 282/11.5 R, 11.5 A, 25; 283/105, 106; 206/459

[56] References Cited

U.S. PATENT DOCUMENTS

| | | | |
|---|---|---|---|
| 1,000,466 | 8/1911 | Watson | 283/105 |
| 1,874,796 | 8/1932 | Palm | 229/73 |
| 2,927,723 | 3/1960 | Johnson | 206/459 X |
| 3,255,952 | 6/1966 | Black | 229/73 |
| 3,786,984 | 1/1974 | Malenge | 229/69 |
| 3,908,892 | 9/1975 | Pelzer | 229/73 |
| 4,192,448 | 3/1980 | Porth | 383/86 X |
| 4,440,341 | 4/1984 | Pennock | 229/69 |

*Primary Examiner*—William Price
*Assistant Examiner*—Bryon Gehman
*Attorney, Agent, or Firm*—Allegretti, Newitt, Witcoff & McAndrews, Ltd.

[57] ABSTRACT

A continuous business form assembly provides for printing internal and external information on a single web in one, single-sided printing operation. Label portions cut in the forms are foldable for the printing. Attachment sheets and adhesive return the label portions to sealed, label positions where label information is external to the forms.

2 Claims, 10 Drawing Figures

FLIP DIE CUT LABEL FOR FOLDED MAILER

This application is a continuation of application Ser. No. 539,129, filed Oct. 5, 1983, now abandoned.

BACKGROUND AND FIELD OF THE INVENTION

1. Field of the Invention

This invention relates to continuous business form assemblies, and especially such assemblies of the type forming envelope mailers having die cut windows.

2. Background of the Invention

Envelope mailers are formed from continuous single webs printed on one side in one printing operation. Such mailers have die cut windows that allow printed recipient address information to appear through the windows. Envelope mailers of this type have limited usefulness and may be wasteful of postage because no inserts can be included. Inserts block the windows. As a result, envelope mailers are generally printed in two or more printing operations, at much greater printing expense, or printed externally, in one operation, through the use and expense of carbons.

SUMMARY OF THE INVENTION

An object of the present invention is to provide an improved continuous business form assembly of envelope mailers in which all printing could be accomplished in one printing operation on one side of a single web, for positive, original printing of all information, and wherein the envelope mailers could accommodate insert webs for advertising inserts, return envelopes, post cards and the like.

In a principal aspect, then, the invention is a continuous business form assembly comprising a continuous web having a continuous series of business forms thereon. The business forms each have a label portion and a non-label, remainder portion. The web has a first side and an opposite, second side. The label portion has a label face defined on the web first side. The label portion has a label back defined on the web second side. The remainder portion has a remainder face defined on the web second side and a remainder back defined on the web first side. The label face and remainder face are thereby defined on the opposite first and second sides of the web.

The label portions are each partially cut from the business forms along label edges. They are foldable along fold lines to a printing position. In this position, the label backs are against the remainder backs. The label faces are exposed with the remainder faces on the second side of the web for simultaneous printing, in one printing operation on one side, the second side, of the web.

The label portions are also foldable, along the fold lines, after printing to a labelling position. In this labelling position, the label face is returned to exposure on the first side of the web, opposite the remainder face, to act as a label for the business form.

Envelope mailers may be formed from such an assembly, with the label portions being address portions. Such mailers will have been printed in one printing operation on a single side of a single web. However, due to the features of the assembly, insert webs or sheets may be used in the mailers without blockage of the addresses of the mailers.

These and other objects, aspects, advantages and features of the invention will be presented as part of the detailed description of the preferred embodiment, which follows a brief description of the drawing.

BRIEF DESCRIPTION OF THE DRAWING

The preferred embodiment of the present invention will be described in relation to the accompanying drawing, in which.

DETAILED DESCRIPTION OF THE PREFERRED EMBODIMENT

Referring to FIGS. 1–9, a preferred continuous business form assembly is shown generally at 12. Another preferred continuous business form assembly is shown generally at 14 in FIG. 10. Assembly 14, shown in FIG. 10, is a currently commercially preferred embodiment of the invention. As will be come apparent, the assembly 14 is constructed similarly to assembly 12. Thus, to aid clarity and conciseness, assembly 14 is described with reliance on a description of assembly 12.

Figure 1:
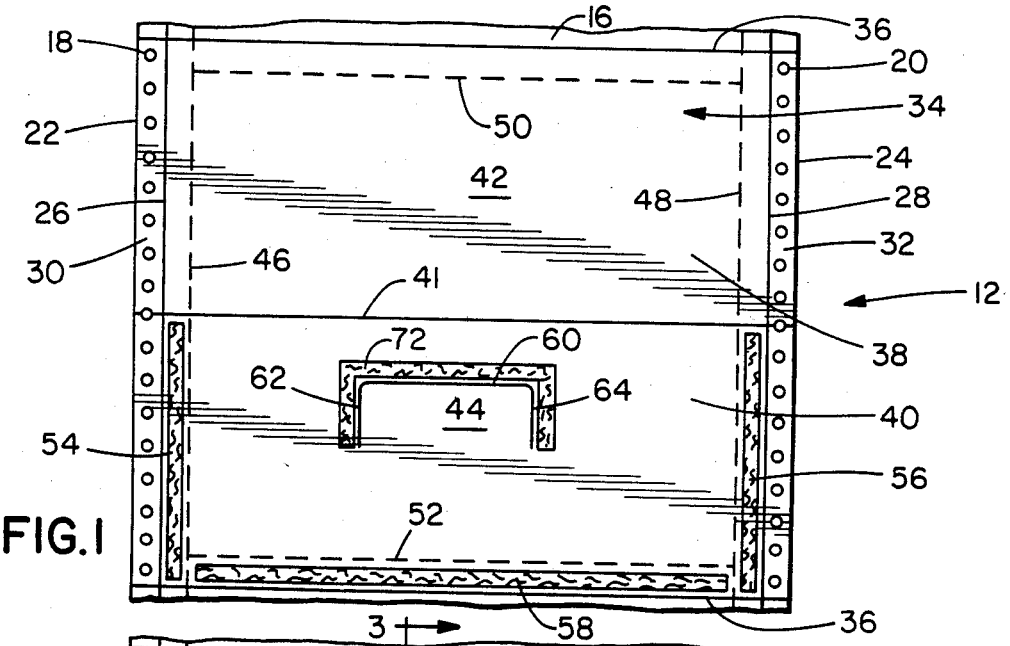
FIG. 1 is a first plan view of a portion of a first, preferred, continuous business form assembly according to the invention, during a stage of construction.
Figure 3:
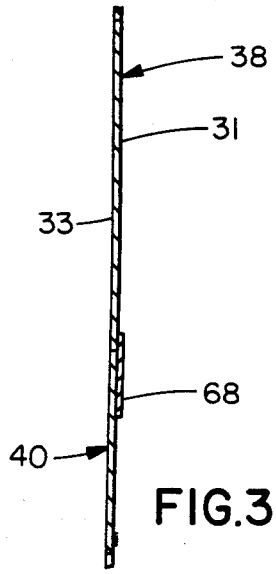
FIG. 3 is a cross-section view taken along line 3—3 of FIG. 2.

Referring to FIG. 1, the assembly 12 comprises a continuous web 16 having longitudinal extending, marginal and continuous series of pin feed holes 18, 20 along its longitudinally extending side edges 22, 24. Longitudinal extending marginal perforation lines 26, 28, adjacent the feed holes 18, 20 define marginal feed strips 30, 32 in which the feed holes 18, 20 are located. Referring to FIG. 3, the web 16 has a first side 31 and an opposite or reverse second side 33.

Between the lines 26, 28, the web 16 has a continuous series of business forms 34. Each form 34 extends longitudinally between two of a series of longitudinally spaced, transversely extending perforation lines 36. Each form 34 includes an envelope back portion 38 and an envelope front portion 40, divided from each other by a transverse fold line 41. The form 34 has a face 42 defined on the first side 31 of the web 16, and a back defined on the second side 33 of the web 16. The face 42 is defined as extending across the envelope front and back portions 38, 40, with the exception of a label portion 44. By definition, a label face of the label portion 44 is on the second side 33 of the web 16. A label back of the label portion 44 is on the first side 31 of the web 16.

Non-marginal perforation lines 46, 48 extend longitudinally across the forms 34, adjacent the marginal perforation lines 26, 28. Transverse perforation lines 50, 52 extend across the forms 34 between the non-marginal perforation lines 46, 48, in pairs adjacent and equidistant transverse perforation lines 36.

A first, envelope forming, adhesive strip 54 lies on the envelope face portion 40 of the face 42 between the perforation lines 26, 46, the fold line 41 and a perforation line 36. A second, envelope forming adhesive strip 56 lies on the envelope face portion 40 of the face 42 between the perforation lines 28, 48, the fold line 41 and the same perforation line 36. A third, envelope forming adhesive strip 58 lies on the envelope face portion 40 of the face 42 between the perforation lines 36, 46, 48, 52.

Figure 4:
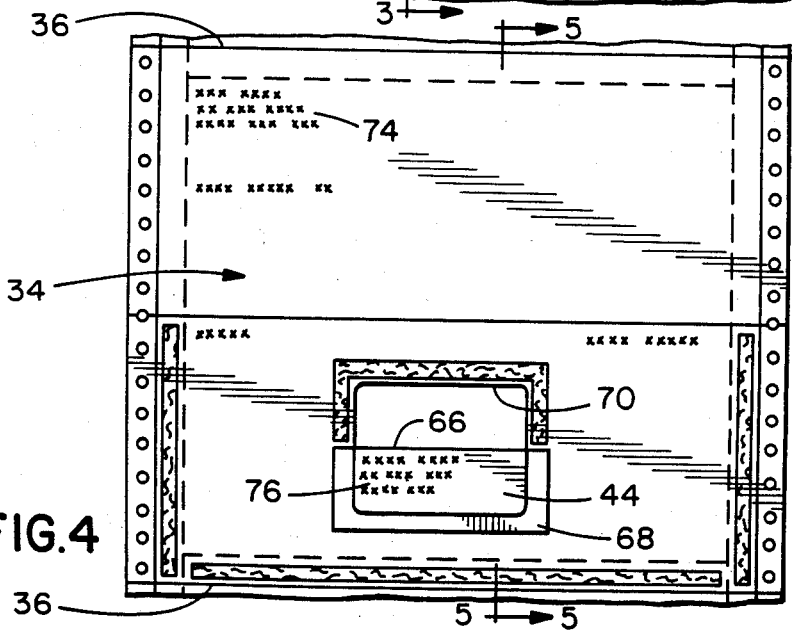
FIG. 4 is a third plan view of the assembly of FIG. 1 during a third stage of construction.

The label portion 44 is, in form 34, an address portion of the envelope face portion 40. The label portion 44 is on the portion 44 between the lines 46, 48 and the lines 41, 52, and is defined on three sides within the portion 40 by a short, transversely extending cut 60 joined at its ends by two transversely spaced, shorter, longitudinally extending cuts 62, 64. The label portion 44 thus forms a flap in the envelope face portion 40. Referring to FIG. 4, by way of example, label portion 44 is foldable about a fold line 66, which defines its fourth side. The label portion 44 is sized, in height from the fold line 66 to the edge adjacent the cut 60, and in width transversely between edges along the cuts 62, 64 to have printed on the label face such information as may be desired. It may, if desired, also be modified in shape.

Figure 2:
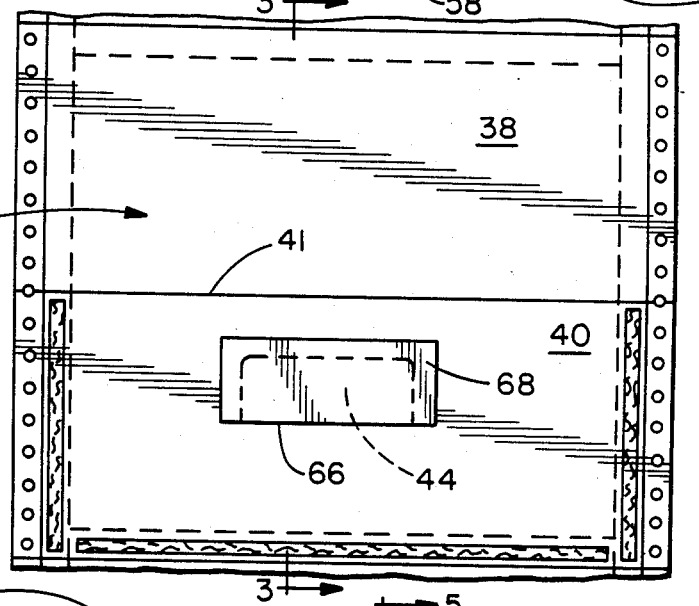
FIG. 2 is a second plan view of the assembly of FIG. 1 during a second stage of construction.

Referring to FIGS. 2 and 3, an attachment sheet 68 is adhered to each label portion 44, on the label back and side 31 of the web. The sheet 68 is larger than the label portion 44. The sheet 68 extends longitudinally, as shown in FIGS. 2 and 3, from the fold line 66 to a height greater than the height of the label portion 44. The sheet extends transversely to a width greater than the label portion 44.

The sheet 68 adapts the label portion 44 to be restricted to being folded between the extreme positions shown in FIGS. 2 and 4. The label portion 44 is restricted, by sheet 68, against being folded through the opening 70 it forms in the direction of the web side 31.

The sheet 68 also adapts the label portion 44 to be attached, when desired, in the position, defined as a labelling position, shown in FIG. 2. Actual attachment is accomplished by a U-shaped adhesive strip 72 on the form 34 shown in FIG. 1, which extends about the flap portion 44.

Figure 5:
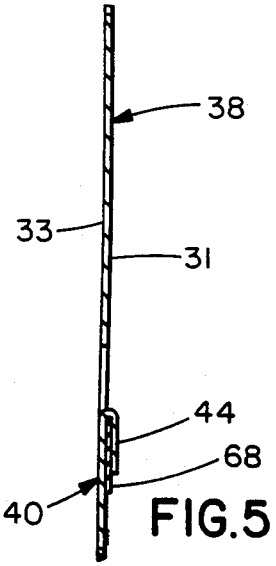
FIG. 5 is a cross-section view taken along line 5—5 of FIG. 4.

So constructed, the assembly 12 is used as follows. As shown in FIGS. 4 and 5, the label portion 44 is folded to a printing position, in which the label back and sheet 68 are adjacent the face 42 of the form 34. Information as desired, such as representative information 74, 76, is printed on the form and label faces in a single, one-sided printing operation.

Figure 6:
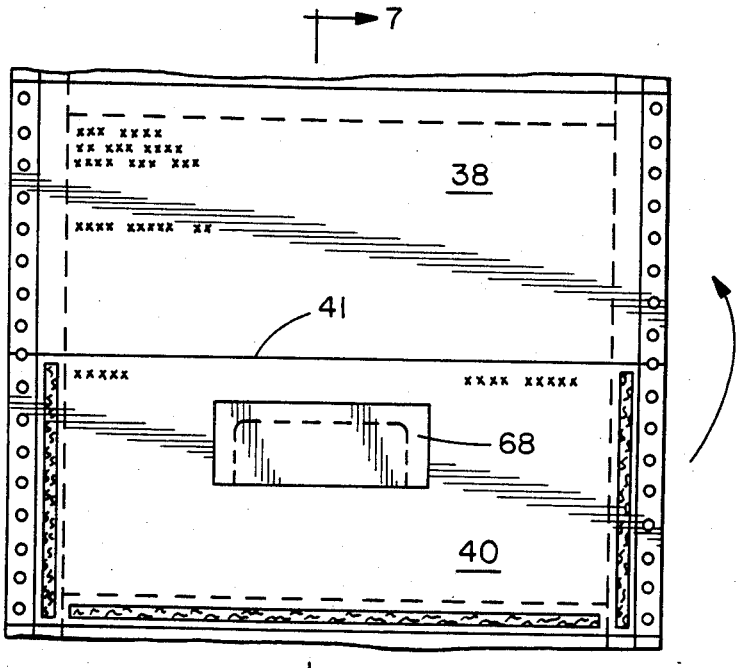
FIG. 6 is a fourth plan view of the assembly of FIG. 1 during a fourth stage of construction.
Figure 7:
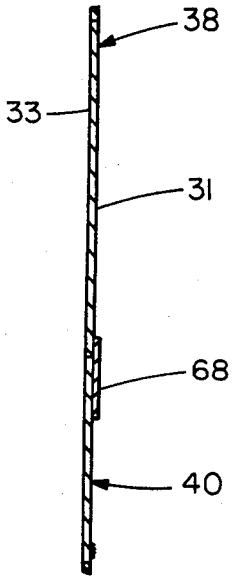
FIG. 7 is a cross-section view taken along line 7—7 of FIG. 6.

As shown in FIGS. 6 and 7, the label portion 44 is then manually or automatically returned to the labelling position. The adhesive of the strip 72 is then activated. The sheet 68 is adhered to the envelope face portion 40 of the form 34 by the strip 72. Such adherence attaches the label portion 44 to the envelope face portion 40 in the labelling position, and seals the opening 70.

Figure 8:
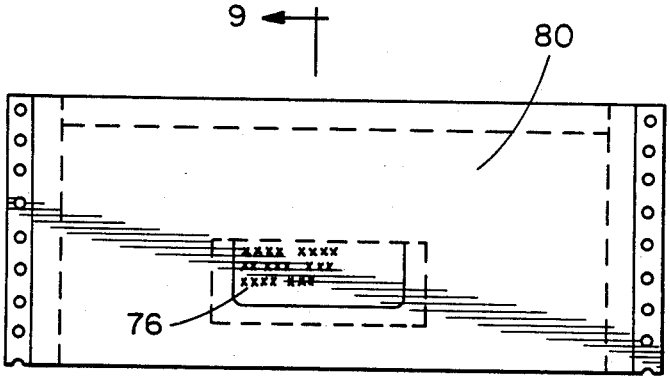
FIG. 8 is a view of a representative completed form of the first preferred assembly.
Figure 9:
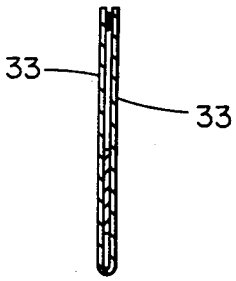
FIG. 9 is a cross-section view of the form 8 taken along line 9—9 of FIG. 8.
Figure 10:
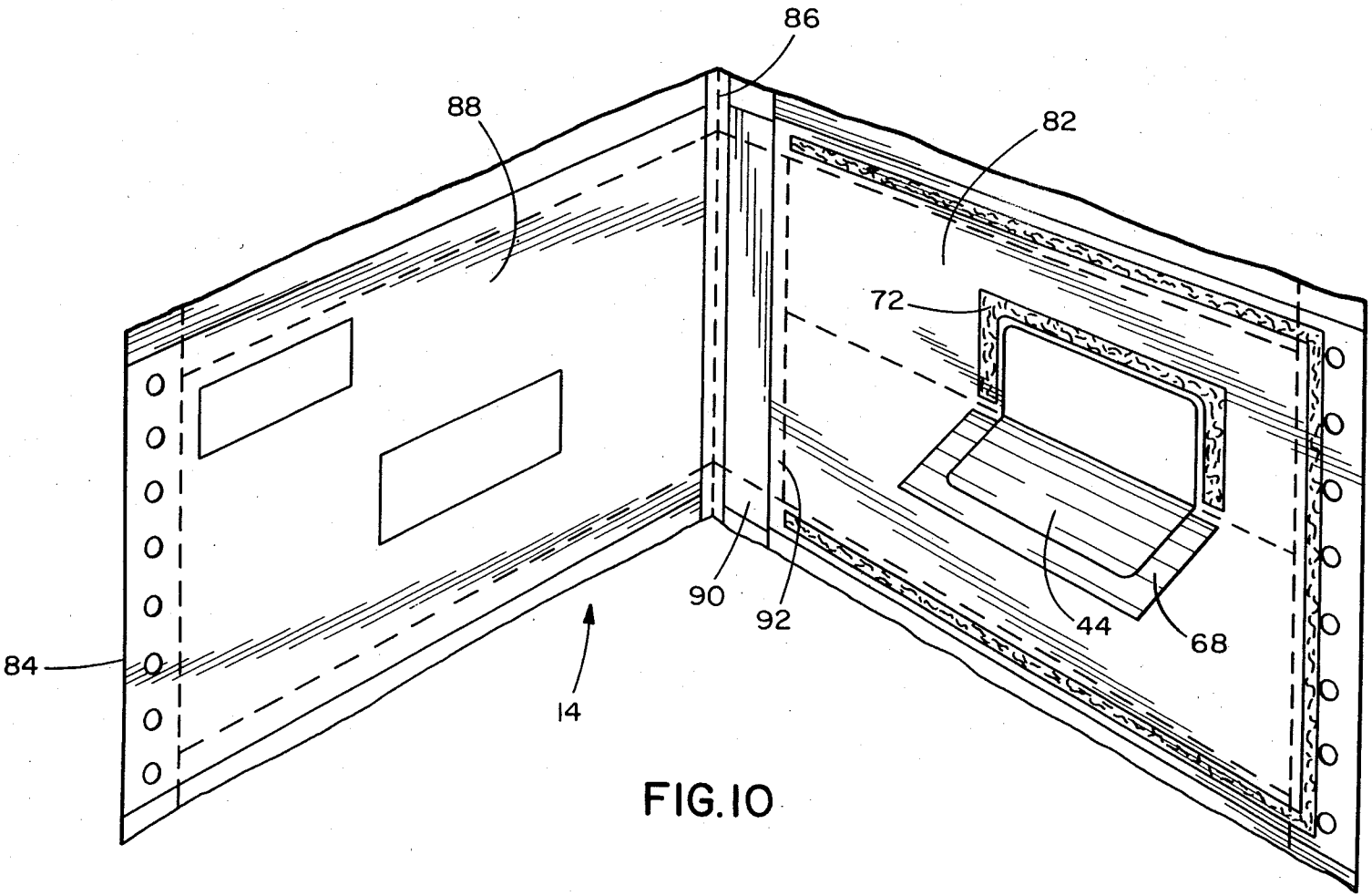
FIG. 10 is a perspective view of a portion of a second preferred, continuous business form assembly, in a stage of construction comparable to that shown in FIG. 4.

Each form 34 may then be detached from the assembly 12 folded and sealed by adhesive strips 54, 56, 58 to create an envelope 80, as shown in FIGS. 8 and 9. The information 76 appears on the outside of the envelope 80. For this reason, insert materials (not shown) may be included in the envelope 80, without obstructing the information 76.

The second assembly 14 is similarly constructed and used. In the assembly 14, the forms 34 of the web 16 are divided transversely into envelope front and back portions 82, 84 by a longitudinal fold line 86. An insert web 88 is applied to the back portion 84 to form a return envelope with the back portion 84. A releasable strip 90 on the front portion 82 adjacent the fold line 86 overlies an adhesive strip (not shown) in an envelope flap area 92 of the envelope front portion 82, for providing a sealable flap for the return envelope.

The preferred embodiments are now described. To particularly point out and distinctly claim the subject matter regarded as invention, the following claims conclude this specification. The term "remainder portion" in the claims refers to the portion of a form other than the label portion.

What is claimed is:

1. A continuous business form assembly comprising a continuous web having a continuous series of business forms and a series of attachment sheets thereon, the business forms each having a label portion and a non-label, remainder portion, the web having a first side and an opposite, second side, the label portion having a label face defined on the web first side and a label back defined on the web second side, the remainder portion having a remainder face defined on the web second side and a remainder back defined on the web first side, the label face and remainder face thereby being defined on the opposite first and second sides of the web, the label portions each being partially cut from the business forms and defining a label edge foldable along a fold line to a printing position in which the label face is exposed with the remainder face on the second side of the web, for simultaneous, second web side printing of the label face and the remainder face, the label portions each also being foldable along the fold line, after printing, to a labelling position in which the label face is returned to exposure on the first side of the web, opposite the remainder face, and acts as a label for the business form, the label portion having a label height from the fold line to a first portion of the label edge and a label width transverse to the label height, each of the attachment sheets being attached to a label back of a label portion and being adapted to attach the label portion to the remainder portion in the labelling position of the label portion, the attachment sheet having a sheet height extending from the fold line beyond the label height and a sheet width greater than the label width, the attachment sheet thereby being adapted to attach the label portion to the remainder portion all along the label edge, to seal the label edge.

2. A continuous business form assembly as in claim 1 in which the label portions are address portions for the printing of address information during the simultaneous, second web side printing.

* * * * *